US011604426B2

(12) United States Patent
Kato

(10) Patent No.: US 11,604,426 B2
(45) Date of Patent: Mar. 14, 2023

(54) IMAGE FORMING APPARATUS CONFIGURED TO CONTROL TARGET TEMPERATURE OF FIXING DEVICE BASED ON EDGE POSITION OF SHEET, AND METHOD FOR CONTROLLING IMAGE FORMING APPARATUS

(71) Applicant: BROTHER KOGYO KABUSHIKI KAISHA, Nagoya (JP)

(72) Inventor: Sadaharu Kato, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/480,640

(22) Filed: Sep. 21, 2021

(65) Prior Publication Data

US 2022/0100129 A1 Mar. 31, 2022

(30) Foreign Application Priority Data

Sep. 29, 2020 (JP) ..... JP2020-163447

(51) Int. Cl.
*G03G 15/20* (2006.01)

(52) U.S. Cl.
CPC ..... *G03G 15/2042* (2013.01); *G03G 15/2039* (2013.01)

(58) Field of Classification Search
CPC ..... G03G 15/2039; G03G 15/2042; G03G 15/2046; H05B 1/0241; H05B 3/0066
USPC ..... 399/69, 334
See application file for complete search history.

(56) References Cited

U.S. PATENT DOCUMENTS

2007/0217804 A1 9/2007 Mikita et al.
2007/0217810 A1* 9/2007 Minagawa ..... G03G 15/2039 399/69
2009/0226202 A1* 9/2009 Kinouchi ..... G03G 15/2042 399/334
2013/0108300 A1* 5/2013 Fujii ..... G03G 15/2042 399/69

(Continued)

FOREIGN PATENT DOCUMENTS

JP H05-119667 A 5/1993
JP H09-179437 A 7/1997

(Continued)

*Primary Examiner* — Robert B Beatty
(74) *Attorney, Agent, or Firm* — Scully, Scott, Murphy & Presser, PC

(57) ABSTRACT

A second heater has such an output that a peak position in a particular direction is located within a largest sheet area. The largest sheet area is an area in which a heating member contacts a sheet having a largest size in the particular direction that is conveyable through a fixing device. A first sensor detects temperature of a center area. A second sensor detects temperature at an outside position in an end area. The outside position is outside the largest sheet area in the particular direction. A controller controls a first heater such that a first detection temperature detected by the first sensor becomes a first target temperature; controls the second heater such that a second detection temperature detected by the second sensor becomes a second target temperature; and determines the second target temperature based on an edge position of a sheet relative to the peak position.

13 Claims, 8 Drawing Sheets

(56) References Cited

U.S. PATENT DOCUMENTS

| | | | | |
|---|---|---|---|---|
| 2013/0188977 | A1* | 7/2013 | Hase | G03G 15/2046 399/334 |
| 2015/0055968 | A1* | 2/2015 | Kadowaki | G03G 15/205 399/69 |
| 2017/0075273 | A1 | 3/2017 | Miura et al. | |
| 2019/0235423 | A1 | 8/2019 | Kato | |

FOREIGN PATENT DOCUMENTS

| | | | |
|---|---|---|---|
| JP | 2007-248909 | A | 9/2007 |
| JP | 2017-58504 | A | 3/2017 |
| JP | 2019-132998 | A | 8/2019 |

* cited by examiner

FIG. 8

| SHEET SIZE | COMBINED PEAK POSITION | (DISTANCE FROM COMBINED PEAK POSITION TO EDGE OF SHEET) | SECOND TARGET TEMPERATURE |
|---|---|---|---|
| A5 SIZE | LONGER THAN OR EQUAL TO D6 | (LONGER THAN OR EQUAL TO D3) | T50 |
| | SHORTER THAN D6 | (SHORTER THAN D3) | T51 |
| A6 SIZE | LONGER THAN OR EQUAL TO D7 | (LONGER THAN OR EQUAL TO D4) | T60 |
| | LONGER THAN OR EQUAL TO D8 AND SHORTER THAN D7 | (LONGER THAN OR EQUAL TO D5 AND SHORTER THAN D4) | T61 |
| | SHORTER THAN D8 | (SHORTER THAN D5) | T62 |

FIG. 9

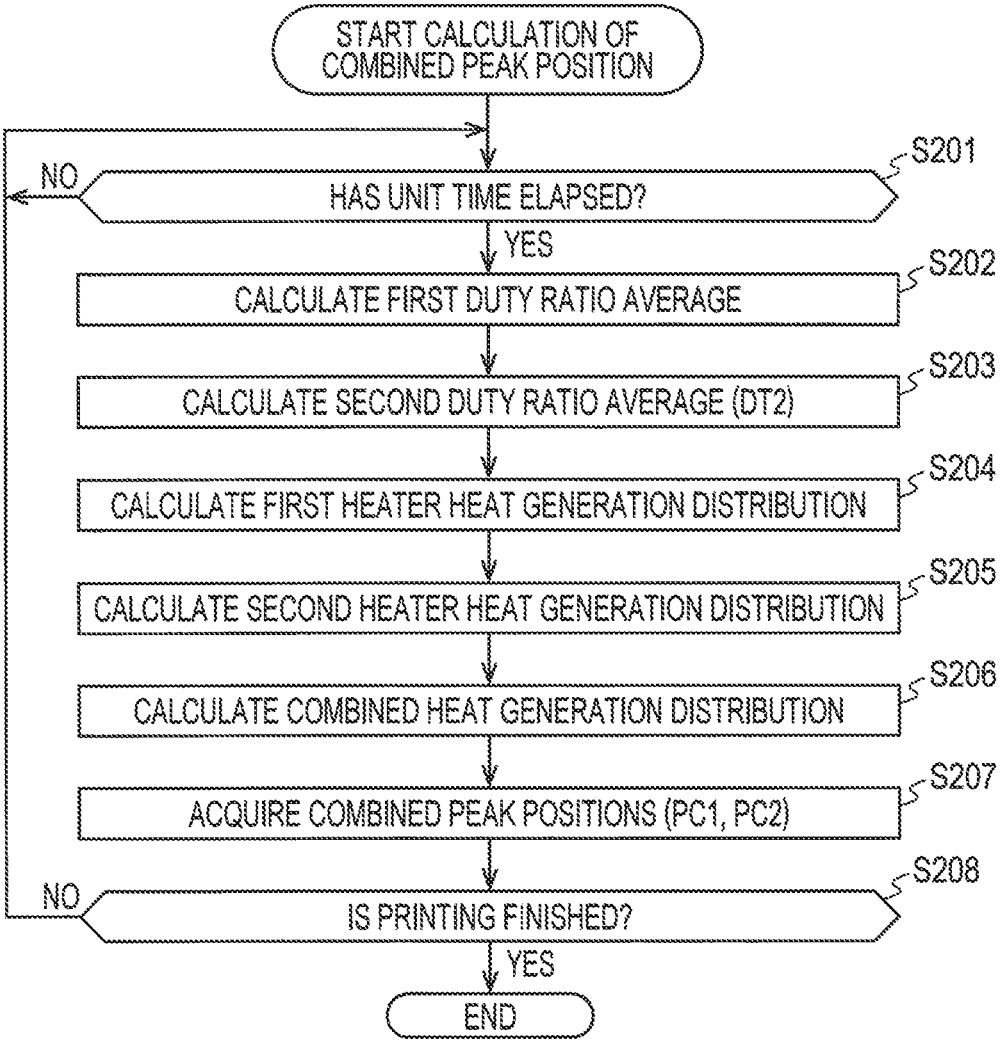

IMAGE FORMING APPARATUS CONFIGURED TO CONTROL TARGET TEMPERATURE OF FIXING DEVICE BASED ON EDGE POSITION OF SHEET, AND METHOD FOR CONTROLLING IMAGE FORMING APPARATUS

CROSS REFERENCE TO RELATED APPLICATIONS

This application claims priority from Japanese Patent Application No. 2020-163447 filed Sep. 29, 2020. The entire content of the priority application is incorporated herein by reference.

BACKGROUND

A known fixing device includes a heating member (fixing roller), a first heater that heats the central part of the heating member, a second heater that heats both ends of the heating member, a center temperature sensor that detects the temperature of a center part of the heating member, an end temperature sensor that detects the temperature of an end portion of the heating member, and a controller.

SUMMARY

According to one aspect, this specification discloses an image forming apparatus. The image forming apparatus includes a fixing device, and a controller. The fixing device is configured to fix a toner image formed on a sheet. The fixing device includes a heating member, a first heater, a second heater, a first sensor, and a second sensor. The heating member is configured to heat the sheet. The heating member extends in a particular direction. The particular direction is a direction that intersects a conveyance direction of the sheet in the fixing device. The first heater is configured to heat a center area of the heating member in the particular direction more strongly than an end area of the heating member. The end area is located outside the center area in the particular direction. The second heater is configured to heat the end area more strongly than the center area. The second heater has such an output that a peak position in the particular direction is located within a largest sheet area. The largest sheet area is an area in which the heating member contacts a sheet having a largest size in the particular direction that is conveyable through the fixing device. The first sensor is configured to detect temperature of the center area. The second sensor is configured to detect temperature at an outside position in the end area. The outside position is outside the largest sheet area in the particular direction. The controller is configured to: control the first heater such that a first detection temperature detected by the first sensor becomes a first target temperature; control the second heater such that a second detection temperature detected by the second sensor becomes a second target temperature; and determine the second target temperature based on an edge position of the sheet relative to the peak position in the particular direction.

According to another aspect, this specification also discloses an image forming apparatus. The image forming apparatus includes a fixing device and a controller. The fixing device is configured to fix a toner image formed on a sheet. The fixing device includes a heating member, a first heater, a second heater, a first sensor, and a second sensor. The heating member is configured to heat the sheet. The heating member extends in a particular direction. The particular direction is a direction that intersects a conveyance direction of the sheet in the fixing device. The first heater is configured to heat a center area of the heating member in the particular direction more strongly than an end area of the heating member. The end area is located outside the center area in the particular direction. The second heater is configured to heat the end area more strongly than the center area. The first sensor is configured to detect temperature of the center area. The second sensor is configured to detect temperature of the end area. The controller is configured to: control the first heater such that a first detection temperature detected by the first sensor is maintained near a first target temperature; control the second heater such that a second detection temperature detected by the second sensor is maintained near a second target temperature; and determine the second target temperature based on a size of the sheet on which the toner image to fix is formed.

According to still another aspect, this specification also discloses a method for controlling an image forming apparatus. The image forming apparatus includes a fixing device configured to fix a toner image formed on a sheet. The fixing device includes: a heating member configured to heat the sheet, the heating member extending in a particular direction, the particular direction is a direction that intersects a conveyance direction of the sheet in the fixing device; a first heater configured to heat a center area of the heating member in the particular direction more strongly than an end area of the heating member, the end area being located outside the center area in the particular direction; and a second heater configured to heat the end area more strongly than the center area, the second heater having such an output that a peak position in the particular direction is located within a largest sheet area, the largest sheet area being an area in which the heating member contacts a sheet having a largest size in the particular direction that is conveyable through the fixing device. The method includes: energizing the first heater such that a temperature of the center area becomes a first target temperature; energizing the second heater such that a temperature at an outside position in the end area becomes a second target temperature, the outside position being outside the largest sheet area in the particular direction; and determining the second target temperature based on an edge position of the sheet relative to the peak position in the particular direction.

BRIEF DESCRIPTION OF THE DRAWINGS

Embodiments in accordance with this disclosure will be described in detail with reference to the following figures wherein:

FIG. 8 is a table for determining a second target temperature;

FIG. 9 is a flowchart showing a combined peak position calculation process.

DETAILED DESCRIPTION

In the above-mentioned technology, when the detection temperature of the end temperature sensor falls below a control temperature, the controller turns on the second heater, assuming that the surface temperature of the sheet passing area at the end of the heating member has fallen below the set temperature. When the detection temperature of the end temperature sensor exceeds the control temperature, the controller turns off the second heater, assuming that the surface temperature of the sheet passing area at the end of the heating member has exceeded the set temperature.

The end temperature sensor is arranged at the heating member outside the sheet passing area of the maximum size, and the distance between the edge of the sheet and the end temperature sensor in the width direction of the sheet changes depending on the size of the passing sheet. Thus, depending on the distance between the edge of the sheet and the end temperature sensor, the temperature of a part of the end portion of the heating member where the sheet passes is reduced since heat is taken away by the sheet. On the other hand, in a part of the heating member detected by the end temperature sensor, heat is not easily taken away by the sheet and the temperature is not easily reduced. In this case, in the above-mentioned configuration, the detection temperature of the end temperature sensor does not fall below the control temperature, so the second heater does not turn on and the output of the second heater does not increase. Thus, the amount of heat given by the second heater to the part of the heating member where the sheet passes may be insufficient.

In view of the foregoing, an aspect of an objective of this disclosure is to provide an image forming apparatus configured to give an appropriate amount of heat to a heating member with a second heater regardless of the position of the edge of a sheet in the width direction of the sheet.

Hereinafter, an embodiment of this disclosure will be described in detail with reference to the drawings as appropriate.

Figure 1:
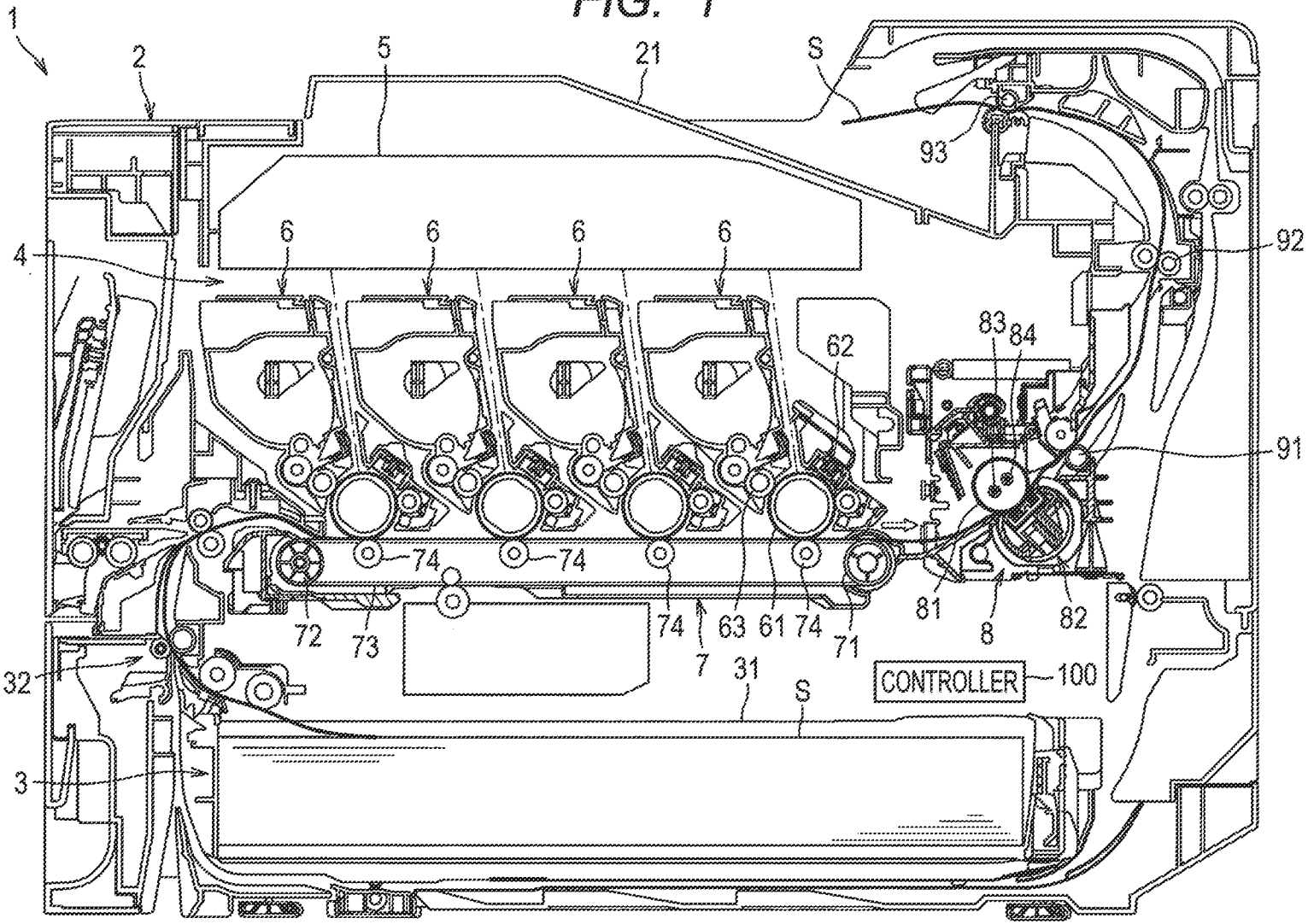
FIG. 1 is a diagram showing an image forming apparatus.

As shown in FIG. 1, an image forming apparatus 1 is a color printer capable of forming a color image, and includes a supply unit 3, a process unit 4, a fixing device 8, and a controller 100 in a main housing 2.

The supply unit 3 includes a supply tray 31 and a supply mechanism 32. The supply unit 3 supplies sheets S accommodated in the supply tray 31 to the process unit 4 one sheet at a time by the supply mechanism 32.

The process unit 4 has a function of forming a toner image on a sheet S. The process unit 4 includes an exposure unit 5, four process cartridges 6, and a transfer unit 7.

The exposure unit 5 includes a light source, a polygon mirror, a lens, a reflecting mirror, and so on (not shown). The exposure unit 5 exposes the surface of a photosensitive drum 61 by emitting a light beam (see the single-dot chain line) based on image data and scanning the surface of the photosensitive drum 61.

Each process cartridge 6 includes the photosensitive drum 61, a charger 62, and a development roller 63. The process cartridge 6 stores toner of yellow, magenta, cyan or black.

The transfer unit 7 includes a drive roller 71, a follow roller 72, a conveyance belt 73, and four transfer rollers 74. The conveyance belt 73 is an endless belt, and is stretched between the drive roller 71 and the follow roller 72. The transfer rollers 74 are arranged inside the conveyance belt 73 so as to sandwich the conveyance belt 73 with the corresponding photosensitive drums 61.

The process unit 4 charges the surface of the photosensitive drum 61 with the charger 62 and then exposes the same with the exposure unit 5. Then, an electrostatic latent image based on the image data is formed on the surface of the photosensitive drum 61. Next, the process unit 4 supplies toner from the development roller 63 to the electrostatic latent image formed on the photosensitive drum 61. As a result, a toner image is formed on the photosensitive drum 61.

After that, the process unit 4 conveys the sheet S supplied from the supply unit 3 by the conveyance belt 73 to cause the sheet S to pass between the photosensitive drum 61 and the transfer roller 74, thereby transferring the toner image formed on the photosensitive drum 61 to the sheet S. With this operation, a toner image is formed on the sheet S.

The fixing device 8 has a function of fixing the toner image formed on the sheet S. The fixing device 8 includes a heating member 81, a pressurizing unit 82, a first heater 83, and a second heater 84. The heating member 81 is a cylindrical roller that heats the sheet S, and is made of metal, for example. The pressurizing unit 82 includes an endless pressurizing belt, a pressurizing pad arranged so as to sandwich the pressurizing belt with the heating member 81, a belt guide that rotatably guides the pressurizing belt, and so on, which are shown without reference numerals. The pressurizing unit 82 is arranged so as to sandwich the sheet S with the heating member 81. The first heater 83 and the second heater 84 heat the heating member 81, and are arranged inside the heating member 81.

The fixing device 8 fixes the toner image on the sheet S by conveying the sheet S on which the toner image is formed by the process unit 4 between the heating member 81 heated by the heaters 83 and 84 and the pressurizing unit 82. The sheet S on which the toner image is fixed is conveyed by the conveyance rollers 91 and 92, and is discharged to a discharge tray 21 formed on the upper surface of the main housing 2 by a discharge roller 93.

Figure 2A:
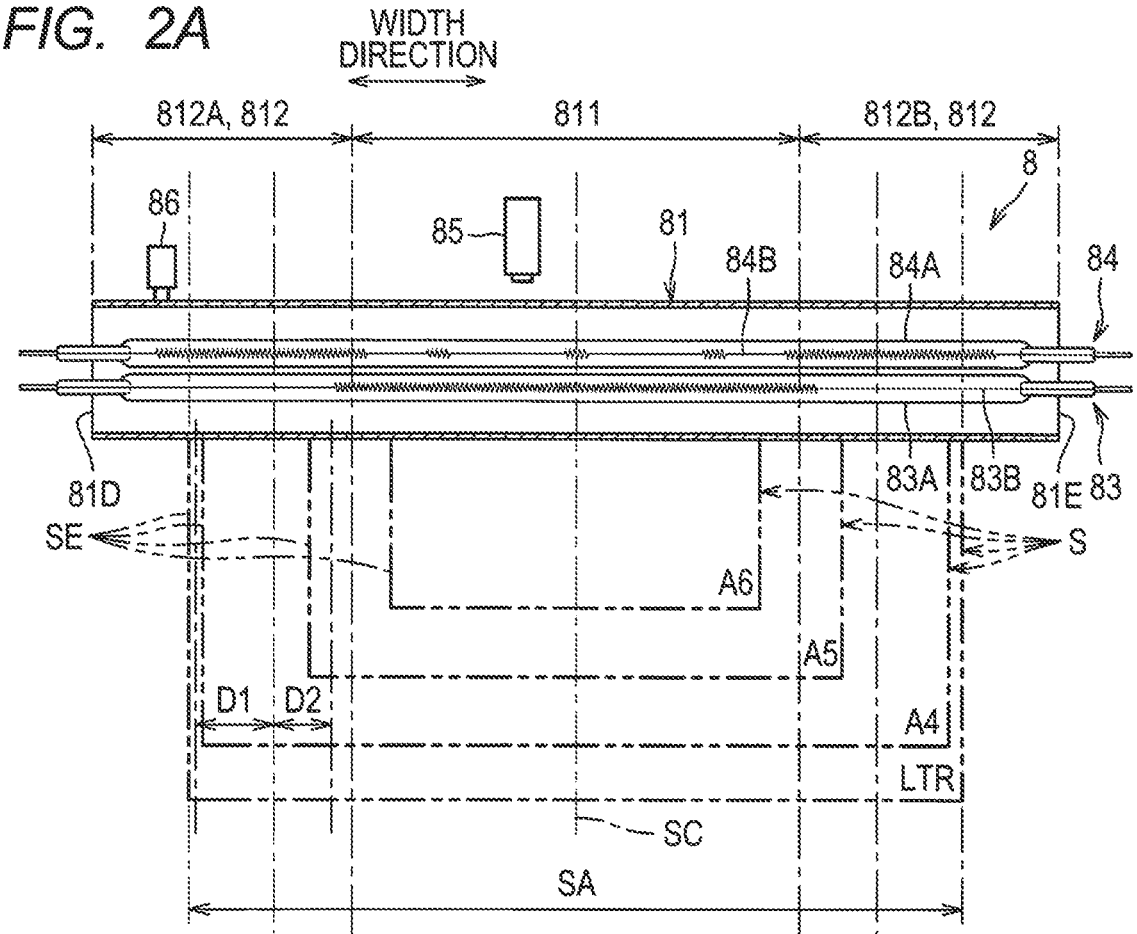
FIG. 2A is a diagram showing a configuration around a heating member of a fixing device.

As shown in FIG. 2A, the fixing device 8 further includes a first sensor 85 and a second sensor 86 in addition to the heating member 81, the first heater 83, and the second heater 84.

The first heater 83 is a halogen heater having a glass tube 83A and a filament 83B provided in the glass tube 83A. In the filament 83B, a heat generating part is concentrated in the center part in the width direction of the sheet S, as compared with each end in the width direction of the sheet S. Thus, the first heater 83 heats a center area 811 of the heating member 81 more strongly than end areas 812. As shown by the broken line in FIG. 2B, the output of the first heater 83 has a distribution in which the center part in the width direction is the highest and gradually decreases toward both ends in the width direction.

Here, the width direction of the sheet S is a direction perpendicular to the conveyance direction of the sheet S in the fixing device 8. In the following, the width direction of sheet S is also simply referred to as "width direction". The center area 811 of the heating member 81 is an area including the center part of the heating member 81 in the width direction. The end areas 812 of the heating member 81 are areas of the heating member 81 located outside of the center area 811 in the width direction. As the end areas 812, the heating member 81 has a first end area 812A and a second end area 812B. The first end area 812A is an area between the center area 811 and one end edge 81D of the heating member 81. The second end area 812B is an area between the center area 811 and an other end edge 81E of the heating member 81.

Figure 2B:
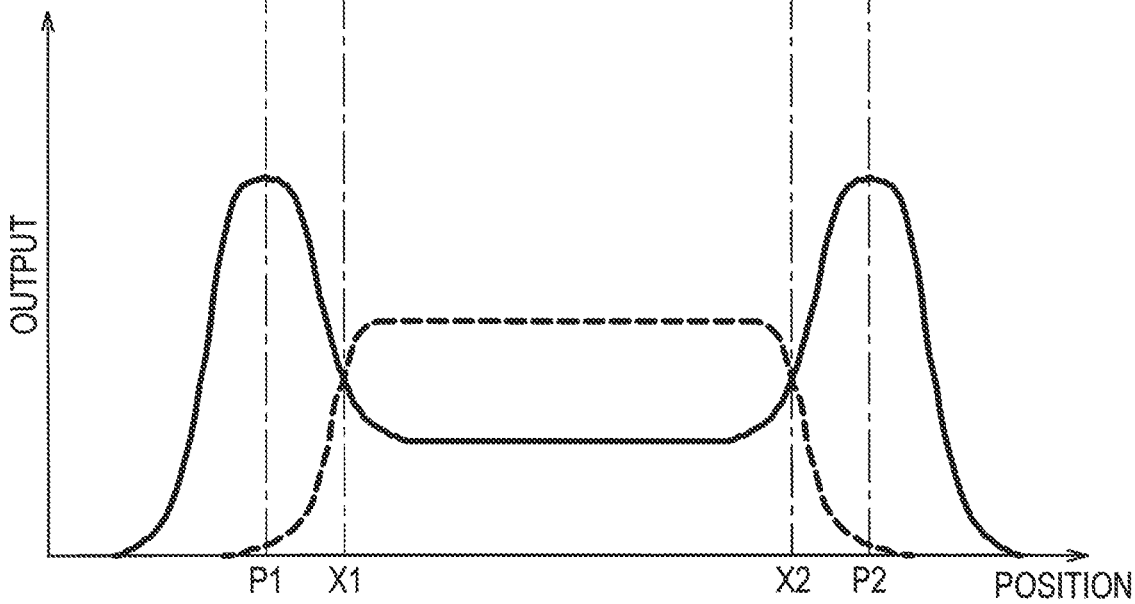
FIG. 2B is a graph showing an output of each heater.

In the present embodiment, the boundaries between the center area 811 and the end areas 812 (812A, 812B) are positions X1 and X2 where a magnitude relationship is reversed, the magnitude relationship being a relationship between the maximum output of the first heater 83 shown by the broken line and the maximum output of the second heater 84 shown by the solid line in FIG. 2B. Here, the maximum output of a heater means the output when power is supplied to the heater at the maximum duty ratio (100 percent).

The second heater 84 is a halogen heater having a glass tube 84A and a filament 84B provided in the glass tube 84A. In the filament 84B, heat generating portions are concentrated at each end in the width direction, compared with the center part in the width direction. With this configuration, the second heater 84 heats the end area 812 of the heating member 81 more strongly than the center area 811. As shown by the solid line in FIG. 2B, the output of the second heater 84 has a distribution in which both end parts in the width direction are higher than the center part.

The fixing device 8 is configured such that the range in which the output of the first heater 83 is maximum (peak position) and the range in which the output of the second heater 84 is maximum (peak positions P1 and P2) does not overlap each other in the width direction. In the first heater 83, the peak position of the output in the width direction is located within a largest sheet area SA. In the second heater 84, the peak positions P1 and P2 of the output in the width direction are also located within the largest sheet area SA.

The largest sheet area SA is an area of the heating member 81 that contacts a maximum size sheet S having a maximum size in the width direction that is conveyable by the fixing device 8 when the maximum size sheet S is conveyed. As an example, in the present embodiment, the maximum size of the sheet S in the width direction that is conveyable by the fixing device 8 is the letter (LTR) size.

The largest sheet area SA overlaps the inner part of each end area 812 in the width direction. That is, the end area 812 has a portion that is located within the largest sheet area SA in the width direction and that is contactable with the sheet S, and a portion that is located outside the largest sheet area SA in the width direction and that does not contact the sheet S.

The light distribution specifications are specified for each heater 83, 84, and the specifications are specified by a particular detection method. As a method of detecting the output (light distribution) of each heater 83, 84, for example, there is a method of arranging an optical sensor for detecting the light of the heater at a particular distance from the heater and detecting the amount of light. The particular distance is the distance from the heater to the inner circumferential surface of the heating member 81.

The first sensor 85 detects the temperature of the center area 811. The first sensor 85 is located at a position shifted toward the first end area 812A from the center (conveyance center SC) in the width direction of the heating member 81. The first sensor 85 is in non-contact with the heating member 81. Specifically, the first sensor 85 is arranged at a distance from the outer circumferential surface of the heating member 81. As the first sensor 85, for example, a non-contact thermistor may be used.

The second sensor 86 detects the temperature of the end area 812. Specifically, the second sensor 86 detects the temperature of the first end area 812A of the end area 812. The second sensor 86 is located outside the largest sheet area SA in the width direction. In other words, the second sensor 86 is arranged in the area of the first end area 812A that does not contact the sheet S in the width direction. Thus, the second sensor 86 detects the temperature of the portion of the first end area 812A that is outside the largest sheet area SA in the width direction, that is, the portion that does not contact the sheet S. The second sensor 86 is in contact with the heating member 81. As the second sensor 86, for example, a contact-type thermistor may be used.

Figure 3:
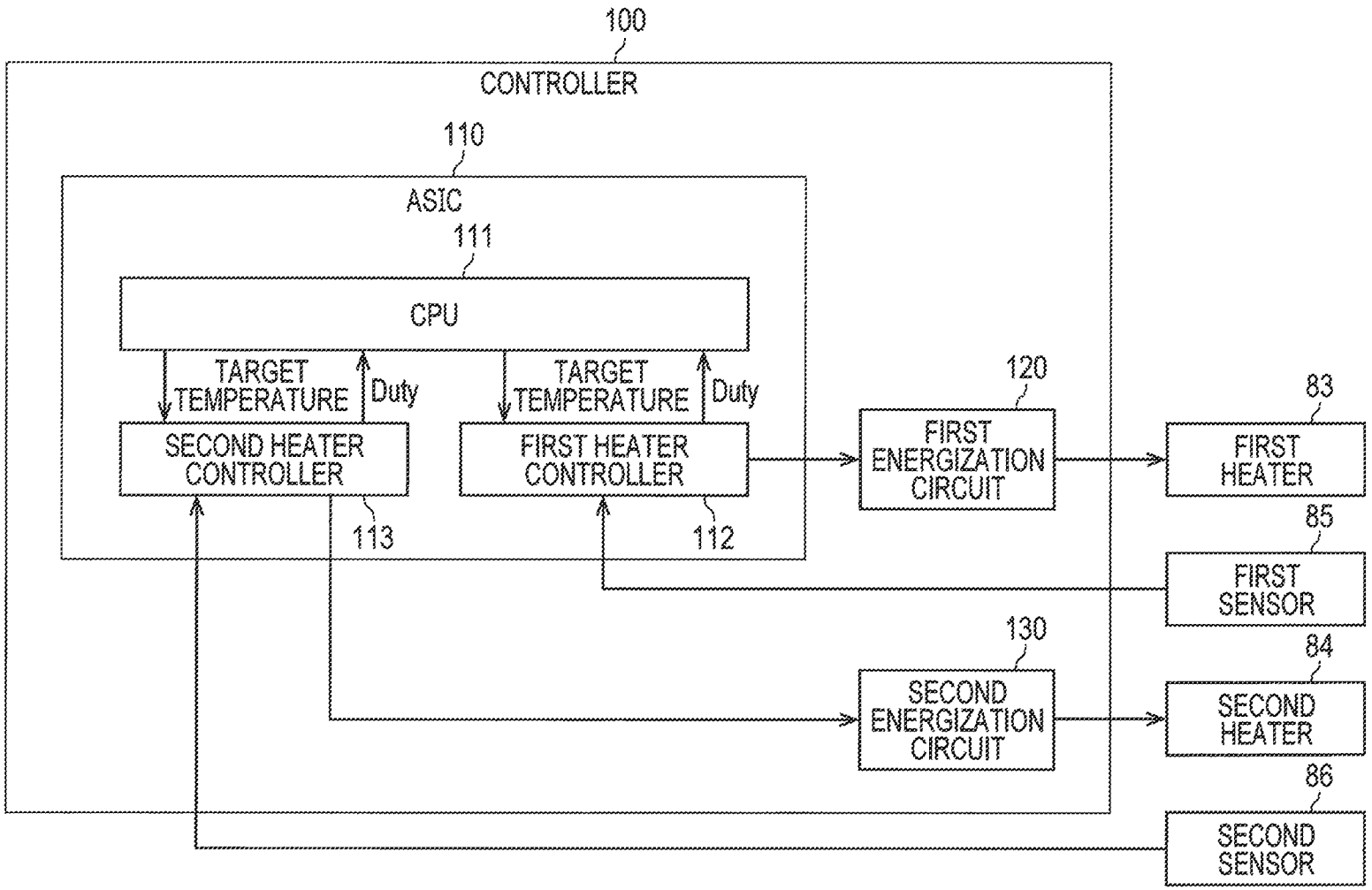
FIG. 3 is a block diagram showing a configuration of a controller.

As shown in FIG. 3, the controller 100 includes an ASIC 110, a first energization circuit 120, and a second energization circuit 130. The ASIC 110 includes a CPU 111, a first heater controller 112, and a second heater controller 113.

The energization circuits 120 and 130 include a switching circuit that switches the inputted AC voltage between an energization state and a non-energization state. The first energization circuit 120 is connected to the first heater 83 and the first heater controller 112. The second energization circuit 130 is connected to the second heater 84 and the second heater controller 113.

The CPU 111 outputs, to the first heater controller 112, a first target temperature TT1 which is the target temperature of the first heater 83. The CPU 111 also outputs, to the second heater controller 113, a second target temperature TT2 which is the target temperature of the second heater 84.

The first heater controller 112 controls energization to the first heater 83 such that the first detection temperature T1 detected by the first sensor 85 becomes the first target temperature TT1. Specifically, the first heater controller 112 determines the energization duty ratio of the AC voltage to be applied to the first heater 83 based on the difference between the first detection temperature T1 and the first target temperature TT1, and performs feedback processing for controlling the first energization circuit 120 with the determined energization duty ratio. The determined energization duty ratio is output to the CPU 111, and the CPU 111 calculates the amount of energization (the amount of electricity) to the first heater 83 per unit time based on the energization duty ratio.

The second heater controller 113 controls energization to the second heater 84 such that the second detection temperature T2 detected by the second sensor 86 becomes the second target temperature TT2. Specifically, the second heater controller 113 determines the energization duty ratio of the AC voltage to be applied to the second heater 84 based on the difference between the second detection temperature T2 and the second target temperature TT2, and performs feedback processing for controlling the second energization circuit 130 with the determined energization duty ratio. The determined energization duty ratio is output to the CPU 111, and the CPU 111 calculates the amount of energization (the amount of electricity) to the second heater 84 per unit time based on the energization duty ratio.

The energization duty ratio is determined to be closer to 100 percent (%) as the value obtained by subtracting the detection temperature from the target temperature is larger. When the detection temperature is higher than the target temperature, the energization duty ratio is determined to be 0 percent (%).

As shown in FIG. 2, during conveyance of the sheet S by the fixing unit 8, the image forming apparatus 1 conveys the sheet S such that the center of the heating member 81 in the width direction is the conveyance center SC. For fixing of a toner image on the sheet S, the controller 100 determines the second target temperature TT2 depending on the position of an edge SE of the sheet S relative to the peak position P1, P2 of the output from the second heater 84 in the width direction.

More specifically, if the position of the edge SE of the sheet S relative to the peak position P1, P2 in the width direction is outside the peak position P1, P2 and the distance from the peak position P1, P2 to the edge SE of the sheet S in the width direction is longer than or equal to a first distance D1, the controller 100 determines the second target temperature TT2 to be a first temperature T10. In this embodiment, the edge SE of the sheet S of the LTR size is at a position outside the peak position P1, P2 and the distance from the peak position P1, P2 to the edge SE is longer than or equal to the first distance D1.

If the position of the edge SE of the sheet S relative to the peak position P1, P2 in the width direction is outside the peak position P1, P2 and the distance from the peak position P1, P2 to the edge SE of the sheet S in the width direction is shorter than the first distance D1, the controller 100 determines the second target temperature TT2 to be a second temperature T20 which is higher than the first temperature T10. In this embodiment, the edge SE of the sheet S of the A4 size is at a position outside the peak position P1, P2 and the distance from the peak position P1, P2 to the edge SE is shorter than the first distance D1.

If the position of the edge SE of the sheet S relative to the peak position P1, P2 in the width direction is inside the peak position P1, P2, the controller 100 determines the second target temperature TT2 to be a temperature lower than the first temperature T10.

More specifically, if the position of the edge SE of the sheet S relative to the peak position P1, P2 in the width direction is inside the peak position P1, P2 and the distance from the peak position P1, P2 to the edge SE of the sheet S in the width direction is shorter than a second distance D2, the controller 100 determines the second target temperature TT2 to be a third temperature T30 lower than the first temperature T10. In this embodiment, the edge SE of the sheet S of the A5 size is at a position inside the peak position P1, P2 and the distance from the peak position P1, P2 to the edge SE is shorter than the second distance D2.

If the position of the edge SE of the sheet S relative to the peak position P1, P2 in the width direction is inside the peak position P1, P2 and the distance from the peak position P1, P2 to the edge SE of the sheet S in the width direction is longer than or equal to the second distance D2, the controller 100 determines the second target temperature TT2 to be a fourth temperature T40 lower than the third temperature T30. In this embodiment, the edge SE of the sheet S of the A6 size is at a position inside the peak position P1, P2 and the distance from the peak position P1, P2 to the edge SE is longer than or equal to the second distance D2.

In this embodiment, the controller 100 acquires information indicating the size of the sheet S from a print job containing a print command, image data, and so on, and determines the second target temperature TT2 based on the acquired information about the size of the sheet S. More specifically, if the acquired information about the size of the sheet S is information indicating a standard size, the controller 100 determines the second target temperature TT2 based on the acquired information about the size of the sheet S without actually calculating the distance from the peak position P1, P2 to the edge SE of the sheet S.

More specifically, if the size is the LTR size, the controller 100 executes processing assuming that the edge SE of the sheet S is at a position outside the peak position P1, P2 and the distance from the peak position P1, P2 to the edge SE of the sheet S is longer than or equal to the first distance D1. Namely, if the acquired information about the size of the sheet S indicates the LTR size, the controller 100 determines the second target temperature TT2 to be the first temperature T10.

If the size is the A4 size, the controller 100 executes processing assuming that the edge SE of the sheet S is at a position outside the peak position P1, P2 and the distance from the peak position P1, P2 to the edge SE of the sheet S is shorter than the first distance D1. Namely, if the acquired information about the size of the sheet S indicates the A4 size, the controller 100 determines the second target temperature TT2 to be the second temperature T20.

If the size is the A5 size, the controller 100 executes processing assuming that the edge SE of the sheet S is at a position inside the peak position P1, P2 and the distance from the peak position P1, P2 to the edge SE of the sheet S is shorter than the second distance D2. Namely, if the acquired information about the size of the sheet S indicates the A5 size, the controller 100 determines the second target temperature TT2 to be the third temperature T30.

If the size is the A6 size, the controller 100 executes processing assuming that the edge SE of the sheet S is at a position inside the peak position P1, P2 and the distance from the peak position P1, P2 to the edge SE of the sheet S is longer than or equal to the second distance D2. Namely, if the acquired information about the size of the sheet S indicates the A6 size, the controller 100 determines the second target temperature TT2 to be the fourth temperature T40.

Even if the acquired information about the size of the sheet S is not information indicating a standard size but is information about a size arbitrarily set by a user, the peak positions P1 and P2 of output from the second heater 84 are still unchanged in the image forming apparatus 1. Thus, as long as information about the width (length in the width direction) of the sheet S is acquired, it is possible to determine whether the position of the edge SE of the sheet S is outside or inside the peak position P1, P2. If the position of the edge SE of the sheet S is outside the peak position P1, P2, it is further possible to determine whether the distance from the peak position P1, P2 to the edge SE of the sheet S is longer than or equal to the first distance D1. If the position of the edge SE of the sheet S is inside the peak position P1, P2, it is further possible to determine whether the distance from the peak position P1, P2 to the edge SE of the sheet S is shorter than the second distance D2.

If the acquired information about the size of the sheet S is information about a size arbitrarily set by the user, the controller 100 determines the second target temperature TT2 to be one of temperatures from the first temperature T10 to the fourth temperature T40 based on the position of the edge SE of the sheet S relative to the peak position P1, P2 (outside or inside the peak position P1, P2) and the distance from the peak position P1, P2 to the edge SE of the sheet S.

When the fixing has been performed to a certain extent in a case where toner images are fixed continuously on the sheets S, the controller 100 determines the second target temperature TT2 to be a temperature higher than the temperature at the time of start of the fixing of the toner images on the sheets S. More specifically, in a case where printing is performed continuously, the controller 100 measures elapsed time or the number of sheets S with fixed toner images produced since start of fixing of the toner images on the sheets S. And, when this measurement result R becomes greater than or equal to a particular measurement threshold Rth, the controller 100 determines the second target temperature TT2 to be a temperature higher than the temperature at the time of start of the continuous printing.

More specifically, in a case where printing is performed continuously on the sheets S of the LTR size and the measurement result R becomes greater than or equal to the particular measurement threshold Rth, the controller 100 determines the second target temperature TT2 to be a temperature T11 higher than the first temperature T10.

In a case where printing is performed continuously on the sheets S of the A4 size and the measurement result R becomes greater than or equal to the particular measurement threshold Rth, the controller 100 determines the second target temperature TT2 to be a temperature T21 higher than the second temperature T20.

In a case where printing is performed continuously on the sheets S of the A5 size and the measurement result R becomes greater than or equal to the particular measurement threshold Rth, the controller 100 determines the second target temperature TT2 to be a temperature T31 higher than the third temperature T30.

In a case where printing is performed continuously on the sheets S of the A6 size and the measurement result R becomes greater than or equal to the particular measurement threshold Rth, the controller 100 determines the second target temperature TT2 to be a temperature T41 higher than the fourth temperature T40.

The operation of the controller 100 will be described next. In an example given herein, the size of the sheet S used for printing is any one of the LTR size, the A4 size, the A5 size, and the A6 size.

Figure 4:
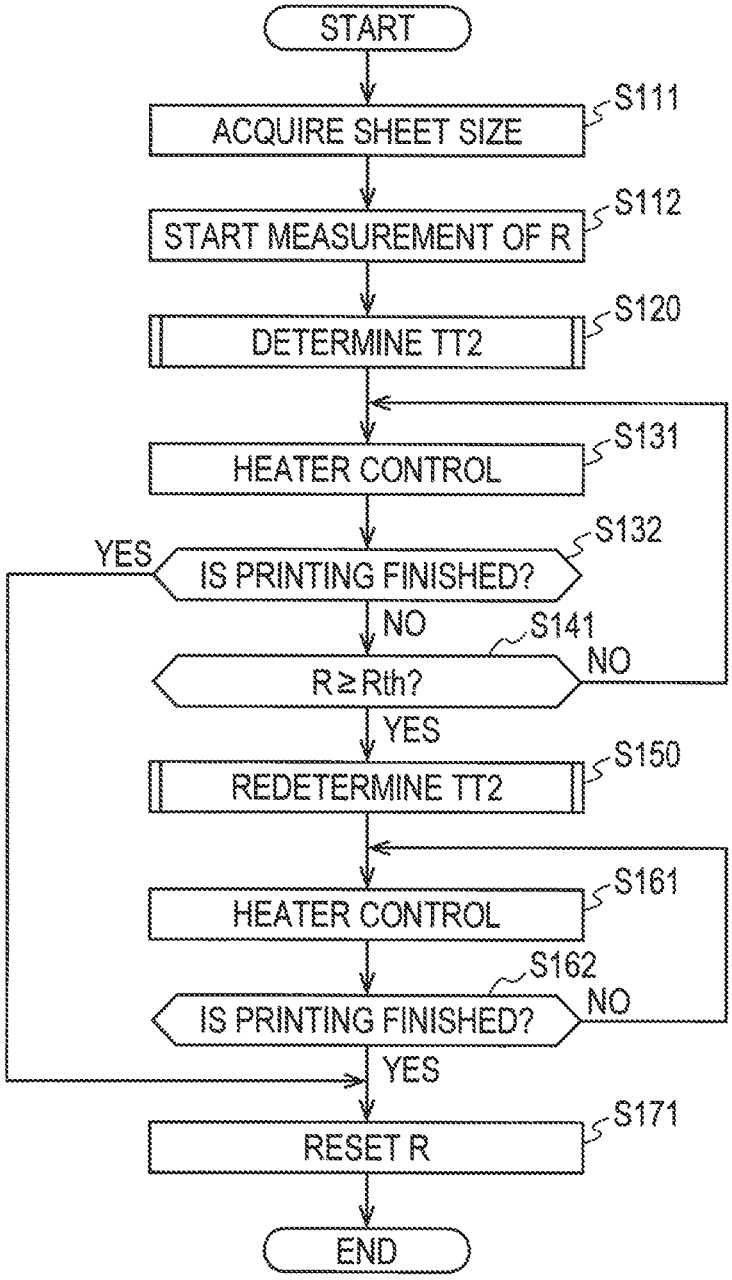
FIG. 4 is a flowchart showing an example of the operation of the controller.

As shown in FIG. 4, in response to input of a print job, the controller 100 acquires information specifying the size of the sheet S (S111). Then, the controller 100 starts measuring elapsed time or the number of prints produced (measurement result R) since printing is started (S112). Next, the controller 100 determines the second target temperature TT2 (S120).

Figure 5:
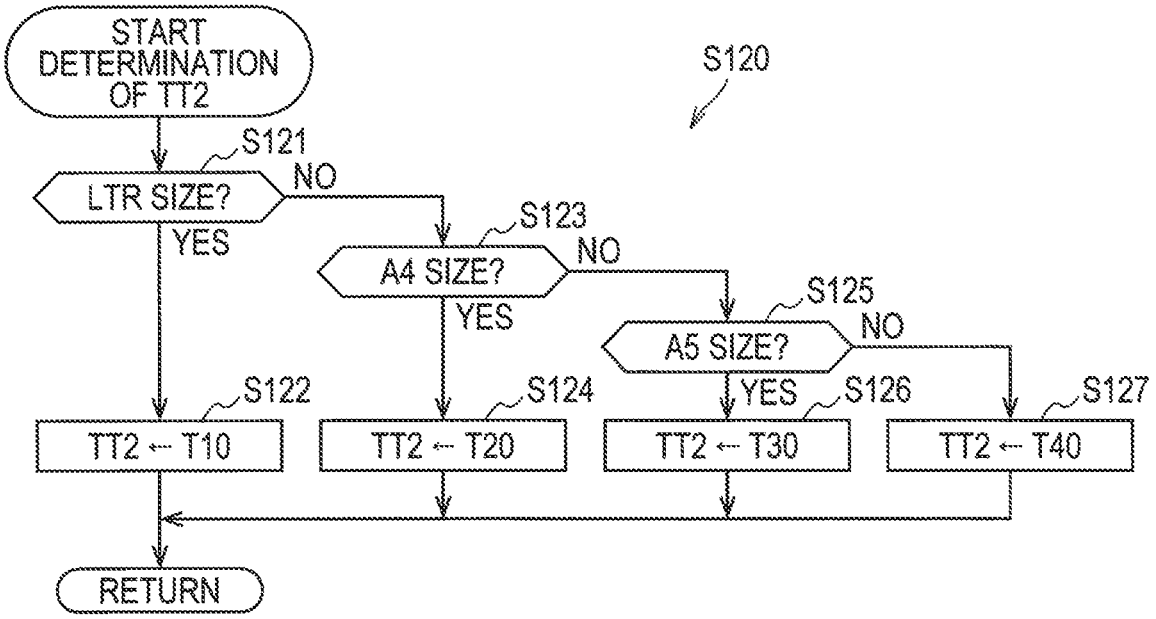
FIG. 5 is a flowchart showing a second target temperature determination process.

As shown in FIG. 5, if the size of the sheet S is the LTR size (S121: Yes), the controller 100 determines the second target temperature TT2 to be the first temperature T10 (S122). If the size of the sheet S is not the LTR size (S121: No) but the A4 size (S123: Yes), the controller 100 determines the second target temperature TT2 to be the second temperature T20 (S124).

If the size of the sheet S is not the A4 size (S123: No) but the A5 size (S125: Yes), the controller 100 determines the second target temperature TT2 to be the third temperature T30 (S126). If the size of the sheet S is not the A5 size (S125: No) but the A6 size, the controller 100 determines the second target temperature TT2 to be the fourth temperature T40 (S127).

Referring back to FIG. 4, the controller 100 controls the first heater 83 based on the first detection temperature T1 and the first target temperature TT1 and controls the second heater 84 based on the second detection temperature T2 and the determined second target temperature TT2 (S131), and fixes a toner image on the sheet S.

If printing is not performed continuously, as the printing is finished (S132: Yes), the controller 100 resets the measurement result R (S171) and finishes the processing. In a case where printing is performed continuously, printing is not finished since there is a sheet S to be printed next (S132: No). The controller 100 determines whether the measurement result R has become greater than or equal to the measurement threshold Rth (S141).

If the measurement result R is smaller than the measurement threshold Rth (S141: No), the controller 100 returns to S131 and continues heater control. If the fixing of toner images on the sheets S has been performed to a certain extent and the measurement result R has become greater than or equal to the measurement threshold Rth (S141: Yes), the controller 100 redetermines the second target temperature TT2 (S150).

Figure 6:
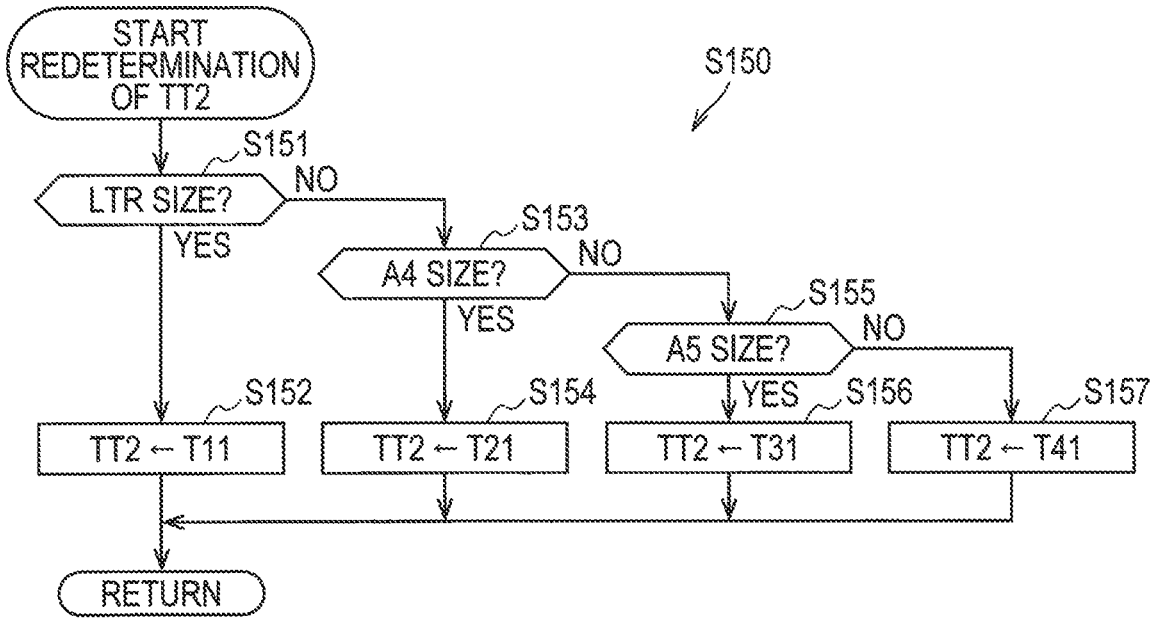
FIG. 6 is a flowchart showing a second target temperature redetermination process.

As shown in FIG. 6, if the size of the sheet S is the LTR size (S151: Yes), the controller 100 determines the second target temperature TT2 to be the temperature T11 (S152). If the size of the sheet S is not the LTR size (S151: No) but the A4 size (S153: Yes), the controller 100 determines the second target temperature TT2 to be the temperature T21 (S154).

If the size of the sheet S is not the A4 size (S153: No) but the A5 size (S155: Yes), the controller 100 determines the second target temperature TT2 to be the temperature T31 (S156). If the size of the sheet S is not the A5 size (S155: No) but the A6 size, the controller 100 determines the second target temperature TT2 to be the temperature T41 (S157).

Referring back to FIG. 4, if there is a sheet S on which fixed is being performed, the controller 100 controls the second heater 84 based on the second detection temperature T2 and the newly determined second target temperature TT2 after the fixing of the toner image on this sheet S is finished (S161), and performs fixing of a toner image on a next sheet S. If the printing is not finished (S162: No), the controller 100 returns to S161 and continues heater control. If the printing is finished (S162, Yes), the controller 100 resets the measurement result R (S171) and finishes the processing.

According to the embodiment described above, for fixing of a toner image, the second target temperature TT2 is determined depending on the position of the edge SE of the sheet S relative to the peak position P1, P2 of output from the second heater 84. Thus, heat of an appropriate quantity is applied to the heating member 81 from the second heater 84 regardless of the position of the edge SE of the sheet S in the width direction.

The description continues in more detail by referring to FIG. 2. Like in the case of the sheet S of the A4 size, if the position of the edge SE of the sheet S relative to the peak position P1, P2 in the width direction is outside the peak position P1, P2 and close to the peak position P1, P2, namely, if the position of detection by the second sensor 86 and the position of the edge SE of the sheet S in the width direction are far from each other, heat is not likely to be taken away by the sheet S so the second detection temperature T2 is not likely to drop in an area of the end area 812 (first end area 812A) where a temperature is detected by the second sensor 86. In contrast, heat is taken away by the sheet S so a temperature drops in an area of the heating member 81 contacting the sheet S.

According to this embodiment, if the position of detection by the second sensor 86 and the position of the edge SE of the sheet S in the width direction are far from each other like in the case of the sheet S of the A4 size, the second target temperature TT2 is set to be higher than the case where the position of detection by the second sensor 86 and the position of the edge SE of the sheet S in the width direction are close to each other like in the case of the sheet S of the LTR size. This reduces the occurrence of shortage in the quantity of heat to be applied from the second heater 84 to the area of the heating member 81 contacting the sheet S.

If the position of the edge SE of the sheet S relative to the peak position P1, P2 in the width direction is inside the peak position P1, P2, namely, if the size of the sheet S in the width direction is small like the A5 size or the A6 size, heat of a small quantity is sufficient as the heat to be applied from the second heater 84 to the end area 812.

According to this embodiment, if the size of the sheet S in the width direction is small like the A5 size or the A6 size, the second target temperature TT2 is set to be lower than the case where the size of the sheet S in the width direction is large like the LTR size or the A4 size. This reduces the probability that an excessive quantity of heat will be applied to the end area 812 from the second heater 84.

According to this embodiment, if the size of the sheet S in the width direction is even smaller like the A6 size, the second target temperature TT2 is set to be even lower than the case of the A5 size. This further reduces the probability that an excessive quantity of heat will be applied to the end area 812 from the second heater 84.

With increase in elapsed time or the number of prints produced since start of fixing, in the area of the heating member 81 contacting the sheets S, heat is taken away by the sheets S that are conveyed continuously so the temperature drops. However, in the area of the heating member 81 where the temperature is detected by the second sensor 86, heat is not likely to be taken away by the sheets S so the second detection temperature T2 is not likely to drop because such area does not contact the sheets S. Then, the difference between the second detection temperature T2 and the second target temperature TT2 does not tend to increase, and hence the output from the second heater 84 does not tend to increase. In this case, shortage may be caused in the quantity of heat to be applied from the second heater 84 to the area of the heating member 81 contacting the sheet S.

According to this embodiment, the second target temperature TT2 is increased in response to increase in elapsed time or the number of fixing produced since start of fixing. This reduces the occurrence of shortage in the quantity of heat to be applied from the second heater 84 to the area of the heating member 81 contacting the sheet S.

According to this embodiment, the second target temperature TT2 is determined based on acquired information about the size of the sheet S. Thus, heat of an appropriate quantity is applied to the heating member 81 from the second heater 84 depending on the size of the sheet S. This further achieves a configuration of applying heat of an appropriate quantity to the heating member 81 from the second heater 84 without providing a structure such as a sensor, for example, for detecting the position of the edge SE of the sheet S in the width direction.

While the disclosure has been described in detail with reference to the above aspects thereof, it would be apparent to those skilled in the art that various changes and modifications may be made therein without departing from the scope of the claims. In the following description, the same elements as those in the embodiment are designated by the same reference numerals, and the description thereof will be omitted.

According to the above-described embodiment, in a case where printing is performed continuously, elapsed time or the number of prints produced since start of the printing is measured. When the measurement result R becomes greater than or equal to the measurement threshold Rth, the second target temperature TT2 is determined to be a temperature higher than the temperature at the time of start of the continuous printing. However, this is not the only control to be performed during implementation of the continuous printing.

Figure 7A:
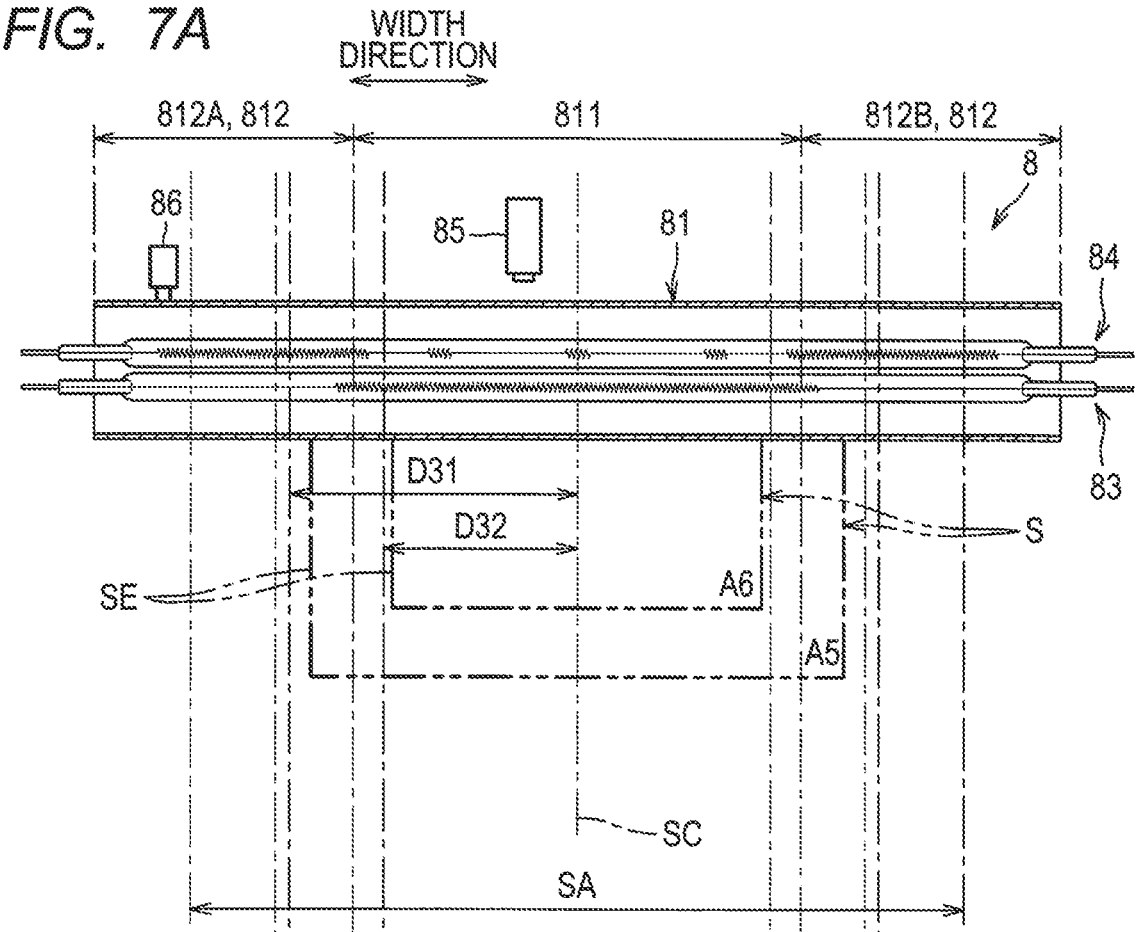
FIG. 7A is a diagram showing a configuration around a heating member of a fixing device.
Figure 7B:
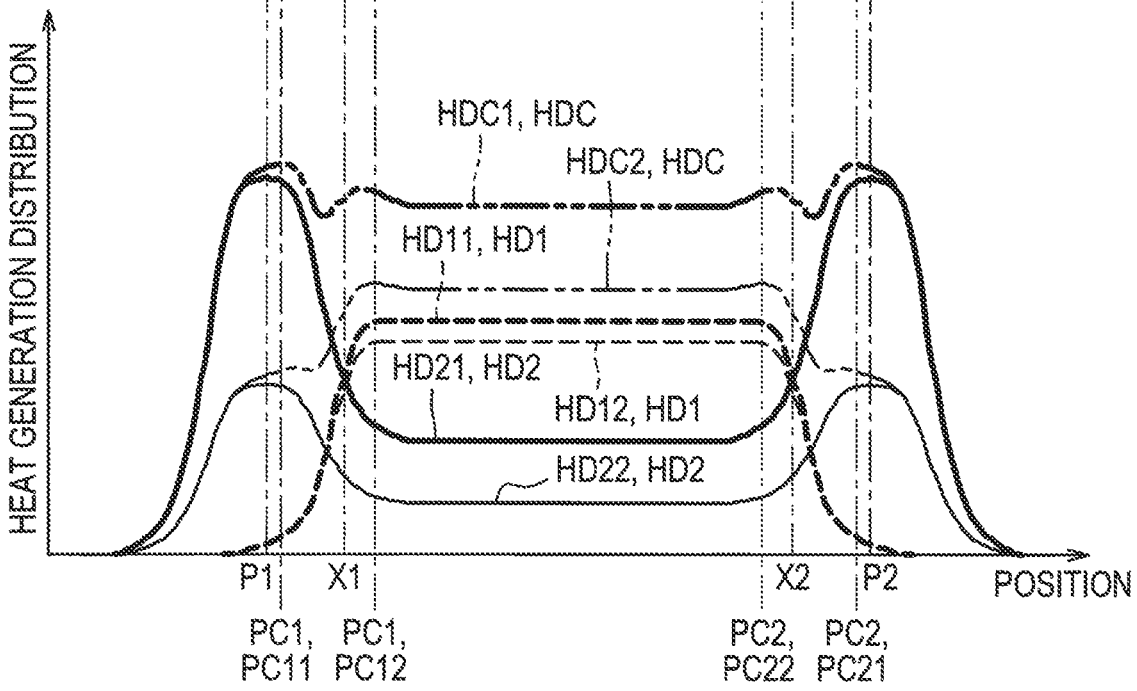
FIG. 7B is a graph showing a heat generation distribution of each heater and a combined heat generation distribution.

For example, the controller 100 may be configured such that, in a case where toner images are fixed continuously on the sheets S of a small size and the energizing duty ratio of the second heater 84 becomes smaller than or equal to a particular duty ratio threshold, the controller 100 determines the second target temperature TT2 depending on the position of the edge SE of the sheet S relative to combined peak position PC1, PC2 in the width direction such as those shown in FIGS. 7A and 7B.

This will be described in more detail. Specifically, the sheet S of a small size is the sheet S where the position of the edge SE of the sheet S relative to the peak position P1, P2 of output from the second heater 84 in the width direction is inside the peak position P1, P2. In an example given herein, this sheet S of a small size means the sheet S of the A5 size and the sheet S of the A6 size.

The combined peak positions PC1 and PC2 are positions of a peak of a heat generation distribution which is formed by combining a heat generation distribution by the first heater 83 and a heat generation distribution by the second heater 84 in the width direction based on the maximum output and energizing duty ratio of the first heater 83 and the maximum output and energizing duty ratio of the second heater 84.

The combined peak positions PC1 and PC2 may be calculated as follows, for example.

First, an average of the energizing duty ratio per unit time (10 seconds, for example) of the first heater 83 (hereinafter called a "first duty ratio average") and an average of the energizing duty ratio per unit time of the second heater 84 (hereinafter called a "second duty ratio average") are calculated.

Next, a heat generation distribution (hereinafter called a "first heater heat generation distribution") HD1 obtained when electric power is supplied to the first heater 83 at the first duty ratio average is calculated based on the maximum output and first duty ratio average of the first heater 83. Similarly, a heat generation distribution (hereinafter called a "second heater heat generation distribution") HD2 obtained when electric power is supplied to the second heater 84 at the second duty ratio average is calculated based on the maximum output and second duty ratio average of the second heater 84.

Next, a heat generation distribution (hereinafter called a "combined heat generation distribution") HDC is calculated by combining the first heater heat generation distribution HD1 and the second heater heat generation distribution HD2. The combined heat generation distribution HDC may be calculated by adding the first heater heat generation distribution HD1 and the second heater heat generation distribution HD2, for example. Then, the combined peak position PC1 at the first end area 812A side and the combined peak position PC2 at the second end area 812B side are acquired from the combined heat generation distribution HDC. The combined peak positions PC1 and PC2 may be acquired as positions where heat generation per unit length (for example, 1 mm) in the width direction is the maximum, for example.

When printing is started, the first duty ratio average and the second duty ratio average are approximately 100 percent. For this reason, a first heater heat generation distribution HD11 is substantially equal to the maximum output from the first heater 83, and a second heater heat generation distribution HD21 is substantially equal to the maximum output from the second heater 84. The combined heat generation distribution HDC calculated in this case is a combined heat generation distribution HDC1. The combined peak positions PC1 and PC2 acquired in this case are combined peak positions PC11 and PC21 close to the peak positions P1 and P2 respectively of output from the second heater 84.

When fixing to the sheets S of the small size has been performed continuously to a certain extent, heat is taken away by the sheets S so the temperature (first detection temperature T1) drops in an area where the temperature is detected by the first sensor 85. This drop in the first detection temperature T1 increases a difference from the first target temperature TT1, which maintains the first duty ratio average at a large value. Thus, a first heater heat generation distribution HD12 is not considerably lower than the first heater heat generation distribution HD11.

When the fixing to the sheets S of the small size has been performed continuously to a certain extent, in an area of the heating member 81 where the temperature is detected by the second sensor 86, heat is not likely to be taken away by the sheets S so the temperature (second detection temperature T2) is not likely to drop. This reduces a difference between the second detection temperature T2 and the second target temperature TT2, which reduces the second duty ratio average. Thus, a second heater heat generation distribution HD22 is lower than the second heater heat generation distribution HD21. In response to this, a combined heat generation distribution HDC2 lower than the combined heat generation distribution HDC1 is calculated as the combined heat generation distribution HDC. And, as the combined peak positions PC1 and PC2, combined peak positions PC12 and PC22 inside the combined peak positions PC11 and PC21 in the width direction are calculated. Note that the combined heat generation distribution HDC2 and the combined peak position PC12, PC22 in FIG. 7B assume a case in which fixing to the sheets S of the A6 size has been performed continuously.

When printing is started, the controller 100 first calculates the combined peak positions PC1 and PC2 per preset unit time. In a case where the printing is performed continuously on the sheets S of the small size and a second duty ratio average DT2 becomes smaller than or equal to a duty ratio threshold DT2th, the controller 100 determines the second target temperature TT2 depending on the position of the edge SE of the sheet S relative to the calculated combined peak position PC1, PC2.

More specifically, as shown in FIG. 8, in a case where the printing is performed continuously on the sheets S of the A5 size and the second duty ratio average DT2 becomes smaller than or equal to the particular duty ratio threshold DT2th and the distance from the combined peak position PC1, PC2 to the edge SE of the sheet S in the width direction is longer than or equal to D3 (third distance), the controller 100 determines the second target temperature TT2 to be a temperature T50 (fifth temperature). In a case where the distance from the combined peak position PC1, PC2 to the edge SE of the sheet S in the width direction is shorter than D3, the controller 100 determines the second target temperature TT2 to be a temperature T51 (sixth temperature) higher than T50.

In a case where the printing is performed continuously on the sheets S of the A6 size and the second duty ratio average DT2 becomes smaller than or equal to the particular duty ratio threshold DT2th and the distance from the combined peak position PC1, PC2 to the edge SE of the sheet S in the width direction is longer than or equal to D4, the controller 100 determines the second target temperature TT2 to be a temperature T60. In a case where the distance from the combined peak position PC1, PC2 to the edge SE of the sheet S in the width direction is longer than or equal to D5 and shorter than D4, the controller 100 determines the second target temperature TT2 to be a temperature T61 higher than the temperature T60. Here, D5 is shorter than D4 (D5<D4). In a case where the distance from the combined peak position PC1, PC2 to the edge SE of the sheet S in the width direction is shorter than D5, the controller 100 determines the second target temperature TT2 to be a temperature T62 higher than the temperature T61. In other words, when the combined peak position PC1, PC2 becomes close to the edge SE of the sheet S, the second target temperature TT2 is increased in order to suppress the temperature drop in the end areas of the sheet in the width direction. Thus, in the present embodiment, the combined peak positions PC1, PC2 are kept at positions outside the edge SE of the sheet S in the width direction.

More specifically, according to this modification, the controller 100 determines the second target temperature TT2 based on a table such as that shown in FIG. 8 without actually calculating the distance from the combined peak position PC1, PC2 to the edge SE of the sheet S in the width direction. The table shown in FIG. 8 contains the size of the sheet S, the combined peak position PC1, PC2 (in more detail, distance D31, D32 from the conveyance center SC to the combined peak position PC1, PC2 in the width direction), and the second target temperature TT2 in association with each other. This table is set in advance by experiments or simulations, for example.

In a case where printing is performed continuously on the sheets S of the A5 size and the second duty ratio average DT2 becomes smaller than or equal to the particular duty ratio threshold DT2th and the combined peak position PC1, PC2 is longer than or equal to D6, the controller 100 determines the second target temperature TT2 to be the temperature T50. In a case where the combined peak position PC1, PC2 is shorter than D6, the controller 100 determines the second target temperature TT2 to be the temperature T51.

In a case where printing is performed continuously on the sheets S of the A6 size and the second duty ratio average DT2 becomes smaller than or equal to the particular duty ratio threshold DT2th and the combined peak position PC1, PC2 is longer than or equal to D7, the controller 100 determines the second target temperature TT2 to be the temperature T60. If the combined peak position PC1, PC2 is longer than or equal to D8 and shorter than D7, the controller 100 determines the second target temperature TT2 to be the temperature T61. Here, D8 is shorter than D7 (D8<D7). If the combined peak position PC1, PC2 is shorter than D8, the controller 100 determines the second target temperature TT2 to be the temperature T62.

The operation of the controller 100 according to the modification will be described next.

As shown in FIG. 9, in response to input of a print job, the controller 100 calculates the combined peak position PC1, PC2. More specifically, if unit time has elapsed (S201: Yes), the controller 100 calculates the first duty ratio average (S202) and calculates the second duty ratio average DT2 (S203).

Next, the controller 100 calculates the first heater heat generation distribution HD1 based on the maximum output and first duty ratio average of the first heater 83 (S204), and calculates the second heater heat generation distribution HD2 based on the maximum output and second duty ratio average DT2 of the second heater 84 (S205). Next, the controller 100 calculate the combined heat generation distribution HDC based on the first heater heat generation distribution HD1 and the second heater heat generation distribution HD2 (S206).

The controller 100 acquires the combined peak position PC1, PC2 from the combined heat generation distribution HDC (S207). If printing is not finished (S208, No), the controller 100 returns to S201. If the printing is finished (S208, Yes), the controller 100 finishes the process of calculating combined peak positions.

Figure 10:
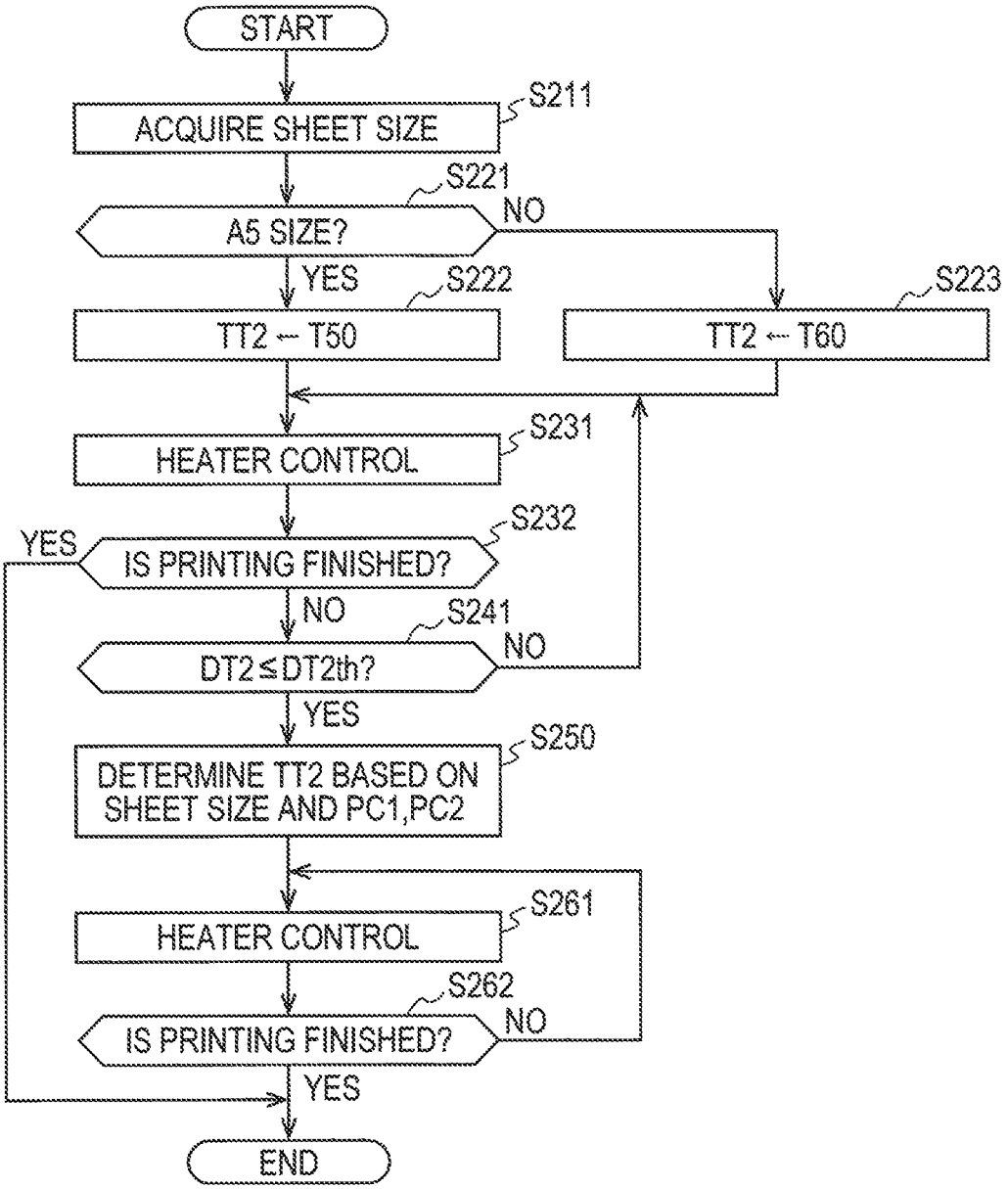
FIG. 10 is a flowchart showing the operation of a controller.

As shown in FIG. 10, in response to input of a print job, the controller 100 acquires information indicating the size of the sheet S (S211). Next, the controller 100 determines the second target temperature TT2. More specifically, if the size of the sheet S is the A5 size (S221: Yes), the controller 100 determines the second target temperature TT2 to be the temperature T50 (S222). If the size of the sheet S is the A6 size (S221: No), the controller 100 determines the second target temperature TT2 to be the temperature T60 (S223).

Then, the controller 100 controls the first heater 83, and controls the second heater 84 based on the second detection temperature T2 and the determined second target temperature TT2 (S231), and fixes a toner image on the sheet S.

If printing is not performed continuously, the controller 100 finishes the processing when the printing is finished (S232: Yes). If printing is performed continuously, printing is not finished (S232: No) and the controller 100 determines whether the second duty ratio average DT2 has become smaller than or equal to the particular duty ratio threshold DT2th (S241).

If the second duty ratio average DT2 is greater than the particular duty ratio threshold DT2th (S241: No), the controller 100 returns to S231. If the second duty ratio average DT2 has become smaller than or equal to the particular duty ratio threshold DT2th (S241: Yes), the controller 100 newly determines the second target temperature TT2 based on the size of the sheet S and the combined peak position PC1, PC2 acquired in step S207 in FIG. 9 and by referring to the table in FIG. 8 (S250).

Then, if there is a sheet S on which a toner image is being fixed, after the fixing of the toner image on this sheet S is finished, the controller 100 controls the second heater 84 based on the second detection temperature T2 and the newly determined second target temperature TT2 (S261), and performs fixing of a toner image on the next sheet S. If the printing is not finished (S262: No), the controller 100 returns to S261. If the printing is finished (S262: Yes), the controller 100 finishes the processing.

According to the above-described modification, in a case where toner images are fixed continuously on the sheets S having a small size in the width direction and the energizing duty ratio of the second heater 84 becomes small, the second target temperature TT2 is determined depending on the position of the edge SE of the sheet S relative to the combined peak position PC1, PC2. Thus, in a case where toner images are fixed continuously on the sheets S of the small size, heat of an appropriate quantity is applied to the heating member 81 from the second heater 84 regardless of the position of the edge SE of the sheet S in the width direction.

More specifically, if toner images are fixed continuously on the sheets S of the small size, the temperature (second detection temperature T2) is not likely to drop in an area of the heating member 81 where the temperature is detected by the second sensor 86. Then, output from the second heater 84 does not tend to increase. In this case, shortage may be caused in the quantity of heat to be applied from the second heater 84 to an area of the heating member 81 contacting the sheets S.

According to this modification, in a case where toner images are fixed continuously on the sheets S of the small size, the second target temperature TT2 is increased when the energizing duty ratio of the second heater 84 is reduced. This reduces the occurrence of shortage in the quantity of heat to be applied from the second heater 84 to the area of the heating member 81 contacting the sheets S.

In the embodiment, the second target temperature TT2 is determined based on the size information of the sheet S acquired by the controller 100, but the present disclosure is not limited to this. For example, the image forming apparatus may include a sensor that detects the position of the edge of the sheet in the width direction, and the controller may actually calculate the position of the edge of the sheet based on the detection result of the sensor and determine the second target temperature according to the calculated position of the edge of the sheet relative to the peak position.

In the embodiment, a heating roller made of metal and so on is illustrated as the heating member 81, but the heating member is not limited to this. For example, the heating member may be configured to include an endless heating belt, a nip forming member arranged to sandwich the heating belt with the pressurizing unit, a belt guide for rotatably guiding the heating belt, and so on. In the embodiment, the pressurizing unit 82 includes a pressurizing belt and a pressurizing pad, but the present disclosure is not limited to this. For example, the pressurizing unit may be a pressure roller having an elastic layer around a core metal.

In the embodiment, halogen heaters that utilizes radiant heat are exemplified as heaters 83 and 84, but the present disclosure is not limited to this. For example, the heater may be a ceramic heater or carbon heater that utilizes the heat generated by a resistor, or an IH heater that induces and heats the heating member. The heater may be located outside the heating member instead of inside the heating member.

In the embodiment, the first sensor 85 is a non-contact thermistor and the second sensor 86 is a contact thermistor, but the disclosure is not limited to this. For example, the first sensor may be a contact thermistor. The second sensor may be a non-contact thermistor. In the embodiment, the thermistor is illustrated as the sensors 85 and 86, but any sensor may be used as long as the sensor detects the temperature of the heating member.

The configuration of the process unit is not limited to the configuration of the embodiment. For example, the exposure unit of the process unit may have an exposure head in which a plurality of LEDs are arranged, and the surface of the photosensitive drum may be exposed by light from the plurality of LEDs. The process unit may include a photosensitive belt instead of the photosensitive drum 61. The process unit may include an intermediate transfer belt instead of the conveyance belt 73.

In the embodiment, a color printer capable of forming a color image is illustrated as an image forming apparatus, but the present disclosure is not limited to this. For example, the image forming apparatus may be a monochrome printer capable of forming only a monochrome image. The image forming apparatus is not limited to a printer, and may be a copying machine, a multifunction peripheral, and so on.

Each element described in the above embodiment and modifications may be implemented in any combination.

What is claimed is:

1. An image forming apparatus comprising:

a fixing device configured to fix a toner image formed on a sheet, the fixing device including:

a heating member configured to heat the sheet, the heating member extending in a particular direction, the particular direction being a direction that intersects a conveyance direction of the sheet in the fixing device;

a first heater configured to heat a center area of the heating member in the particular direction more strongly than an end area of the heating member, the end area being located outside the center area in the particular direction;

a second heater configured to heat the end area more strongly than the center area, the second heater having such an output that a peak position in the particular direction is located within a largest sheet area, the largest sheet area being an area in which the heating member contacts a sheet having a largest size in the particular direction that is conveyable through the fixing device;

a first sensor configured to detect temperature of the center area; and a second sensor configured to detect temperature at an outside position in the end area, the outside position being outside the largest sheet area in the particular direction; and a controller configured to:

control the first heater such that a first detection temperature detected by the first sensor becomes a first target temperature;

control the second heater such that a second detection temperature detected by the second sensor becomes a second target temperature; and determine the second target temperature based on an edge position of the sheet relative to the peak position in the particular direction, wherein determining the second target temperature includes:

in response to a determination that the edge position is outside the peak position in the particular direction and a distance between the peak position and the edge position in the particular direction is longer than or equal to a first distance, determine the second target temperature to be a first temperature; and in response to a determination that the edge position is outside the peak position in the particular direction and the distance between the peak position and the edge position is shorter than the first distance, determine the second target temperature to be a second temperature higher than the first temperature.

2. The image forming apparatus according to claim 1, wherein the controller is configured to, in response to determining that the edge position is inside the peak position in the particular direction, determine the second target temperature to be a temperature lower than the first temperature.

3. The image forming apparatus according to claim 2, wherein the controller is configured to:

in response to determining that the edge position is inside the peak position in the particular direction and the distance between the peak position and the edge position is shorter than a second distance, determine the second target temperature to be a third temperature lower than the first temperature; and in response to determining that the edge position is inside the peak position in the particular direction and the distance between the peak position and the edge position is longer than or equal to the second distance, determine the second target temperature to be a fourth temperature lower than the third temperature.

4. The image forming apparatus according to claim 1, wherein the controller is configured to:

calculate a combined peak position based on a maximum output and a duty ratio of the first heater and on a maximum output and a duty ratio of the second heater, the combined peak position being a peak position of a combined heat generation distribution obtained by combining a heat generation distribution of the first heater and a heat generation distribution of the second heater in the particular direction; and in a case where fixing of toner images is continuously performed on sheets having such a size that the edge position is inside the peak position in the particular direction and the duty ratio of the second heater becomes lower than or equal to a duty ratio threshold, determine the second target temperature depending on the edge position relative to the combined peak position in the particular direction.

5. The image forming apparatus according to claim 4, wherein the controller is configured to:

in response to determining that a distance between the combined peak position and the edge position in the particular direction is longer than or equal to a third distance, determine the second target temperature to be a fifth temperature; and in response to determining that the distance between the combined peak position and the edge position is shorter than the third distance, determine the second target temperature to be a sixth temperature higher than the fifth temperature.

6. The image forming apparatus according to claim 1, wherein the controller is configured to, in a case where fixing of toner images is continuously performed on sheets:

measure an elapsed time since the fixing is started or a number of sheets on which a toner image is fixed; and in response to determining that a measurement result is greater than or equal to a measurement threshold, determine the second target temperature to be a temperature that is higher than a temperature when the fixing is started.

7. The image forming apparatus according to claim 1, wherein the controller is configured to:

acquire information specifying a size of the sheet;

determine the edge position of the sheet relative to the peak position in the particular direction based on the acquired information; and determine the second target temperature based on the edge position.

8. The image forming apparatus according to claim 1, wherein the heating member is a heating roller; and wherein the first heater and the second heater are arranged inside the heating roller.

9. The image forming apparatus according to claim 7, wherein the controller is configured to:

in a case where the acquired information indicates a standard size, determine the second target temperature based on the standard size of the sheet.

10. The image forming apparatus according to claim 9, wherein the controller is configured to:

in a case where the acquired information indicates a LTR size, determine the second target temperature to be the first temperature; and in a case where the acquired information indicates an A4 size, determine the second target temperature to be the second temperature higher than the first temperature.

11. The image forming apparatus according to claim 10, wherein the controller is configured to:

in a case where the acquired information indicates an A5 size, determine the second target temperature to be a third temperature lower than the first temperature; and in a case where the acquired information indicates an A6 size, determine the second target temperature to be a fourth temperature lower than the third temperature.

12. An image forming apparatus comprising:

a fixing device configured to fix a toner image formed on a sheet, the fixing device including:

a heating member configured to heat the sheet, the heating member extending in a particular direction, the particular direction being a direction that intersects a conveyance direction of the sheet in the fixing device;

a first heater configured to heat a center area of the heating member in the particular direction more strongly than an end area of the heating member, the end area being located outside the center area in the particular direction;

a second heater configured to heat the end area more strongly than the center area;

a first sensor configured to detect temperature of the center area; and a second sensor configured to detect temperature of the end area; and a controller configured to:

control the first heater such that a first detection temperature detected by the first sensor is maintained near a first target temperature;

control the second heater such that a second detection temperature detected by the second sensor is maintained near a second target temperature; and determine the second target temperature based on a size of the sheet on which the toner image to fix is formed, wherein determining the second target temperature includes:

in response to a determination that an edge position of the sheet is outside a peak position of an output of the second heater in the particular direction and a distance between the peak position and the edge position in the particular direction is longer than or equal to a first distance, determine the second target temperature to be a first temperature; and in response to a determination that the edge position is outside the peak position in the particular direction and the distance between the peak position and the edge position is shorter than the first distance, determine the second target temperature to be a second temperature higher than the first temperature.

13. A method for controlling an image forming apparatus, the image forming apparatus comprising:

a fixing device configured to fix a toner image formed on a sheet, the fixing device including:

a heating member configured to heat the sheet, the heating member extending in a particular direction, the particular direction being a direction that intersects a conveyance direction of the sheet in the fixing device;

a first heater configured to heat a center area of the heating member in the particular direction more strongly than an end area of the heating member, the end area being located outside the center area in the particular direction; and a second heater configured to heat the end area more strongly than the center area, the second heater having such an output that a peak position in the particular direction is located within a largest sheet area, the largest sheet area being an area in which the heating member contacts a sheet having a largest size in the particular direction that is conveyable through the fixing device, the method comprising:

energizing the first heater such that a temperature of the center area becomes a first target temperature;

energizing the second heater such that a temperature at an outside position in the end area becomes a second target temperature, the outside position being outside the largest sheet area in the particular direction; and determining the second target temperature based on an edge position of the sheet relative to the peak position in the particular direction, wherein determining the second target temperature includes:

in response to a determination that the edge position is outside the peak position in the particular direction and a distance between the peak position and the edge position in the particular direction is longer than or equal to a first distance, determine the second target temperature to be a first temperature; and in response to a determination that the edge position is outside the peak position in the particular direction and the distance between the peak position and the edge position is shorter than the first distance, determine the second target temperature to be a second temperature higher than the first temperature.

* * * * *